US010918185B2

(12) United States Patent
Rita

(10) Patent No.: US 10,918,185 B2
(45) Date of Patent: Feb. 16, 2021

(54) HAIR STYLING DEVICE

(71) Applicant: Ray Rita, Frankfort, IL (US)

(72) Inventor: Ray Rita, Frankfort, IL (US)

( * ) Notice: Subject to any disclaimer, the term of this patent is extended or adjusted under 35 U.S.C. 154(b) by 207 days.

(21) Appl. No.: 14/728,550

(22) Filed: Jun. 2, 2015

(65) Prior Publication Data

US 2016/0360853 A1 Dec. 15, 2016
US 2017/0150799 A9 Jun. 1, 2017

Related U.S. Application Data

(60) Provisional application No. 62/007,654, filed on Jun. 4, 2014.

(51) Int. Cl.
*A45D 24/16* (2006.01)
*A45D 24/36* (2006.01)
*B26B 19/38* (2006.01)

(52) U.S. Cl.
CPC ..... *A45D 24/16* (2013.01); *A45D 24/36* (2013.01); *B26B 19/388* (2013.01)

(58) Field of Classification Search
CPC ..... A45D 24/10; A45D 24/16; A45D 24/36; A46B 15/0036; A46B 15/0055; A46B 15/0038; A46B 15/0002
USPC ..... 33/343
See application file for complete search history.

(56) References Cited

U.S. PATENT DOCUMENTS 4,079,521 A * 3/1978 Uhorczak ..... G01C 9/06 33/366.12
4,217,695 A * 8/1980 Chapman ..... G01B 3/12 132/212
4,467,527 A * 8/1984 North ..... G01C 9/06 33/366.14
4,506,450 A * 3/1985 Fleming ..... G01C 9/06 33/348
4,517,998 A * 5/1985 Furco ..... A45D 24/36 132/148
4,625,423 A * 12/1986 Sackett ..... G01C 9/06 33/366.16
4,716,534 A * 12/1987 Baucom ..... G01C 9/12 250/208.6
5,313,713 A * 5/1994 Heger ..... G01C 9/20 33/343
6,836,972 B2 * 1/2005 Drahos ..... G01C 9/06 33/366.11
8,443,815 B2 * 5/2013 Regalado ..... A45D 24/36 132/148
10,436,584 B2 * 10/2019 Gray ..... G01C 9/26
2008/0060667 A1 * 3/2008 Bandonis ..... A45D 8/30 132/214

(Continued)

*Primary Examiner* — Rachel R Steitz
*Assistant Examiner* — Brianne E Kalach
(74) *Attorney, Agent, or Firm* — Dunlap Codding, P.C.

(57) ABSTRACT

A hair styling device for a hairstylist includes a housing configured to be attachable to a styling tool such as a comb, an electronic-based alignment means that determines the angle of orientation of the housing, and a user-actuated operational control for selecting the housing's desired angle of orientation. The electronic-based alignment means provides a human-perceivable indication of the angle of orientation and can be selectively locked to a desired angle. The electronic-based alignment means also selectively provides a human-perceivable indication when the housing is approaching and has arrived at the desired angle.

11 Claims, 7 Drawing Sheets

(56) References Cited

U.S. PATENT DOCUMENTS

| | | | | |
|---|---|---|---|---|
| 2008/0078418 | A1* | 4/2008 | Ghoorchian | A45D 24/36<br>132/213.1 |
| 2009/0044821 | A1* | 2/2009 | Hatala | A45D 24/36<br>132/200 |

* cited by examiner

HAIR STYLING DEVICE

CROSS-REFERENCE TO RELATED APPLICATIONS

The present patent application is a continuation of the patent application identified by U.S. Ser. No. 62/007,654, filed Jun. 4, 2014, the entire contents of which are hereby incorporated by reference herein.

FIELD OF THE DISCLOSURE

This disclosure generally relates to methods and devices for hair styling. More particularly the disclosure relates to the execution of cutting hair where it is desirable to facilitate a consistent, precise haircut.

BACKGROUND

Hair combs and their various uses are well known in the art. For example, during a haircut, a comb can be used as a reference plane, level, and edge. However, using combs that are known in the prior art as levels or reference planes does not always achieve consistent haircuts because such uses suffer from several problems.

For example, combs generally do not have a means for indicating whether the comb is level. Without a level-indicator, a stylist must rely on his own best guess as to what is straight to attempt a consistent haircut. These combs also make it difficult to achieve a haircut where the left-hand side that matches the right-hand side because the cut is made in two stages. If the stylist's eyesight or arm angle varies from one side to the other, the desired symmetry is often lost.

U.S. Patent Application 2014/0053861 to Hirmiz discloses a hairdresser's comb with a recess that houses a transparent bubble level. The bubble level indicates the vertical, horizontal, and 45 degrees positions of the comb. While this apparatus solves some of the problems experienced by stylists using combs that have no level indicator whatsoever, the comb proposed by Hirmiz is not always accurate as it still leaves plenty of room for human error. For example, a bubble level does not give an exact reading. There is no signal disclosed in the Hirmiz Application to indicate when the comb is in a desired position and a bubble level does not allow the stylist to pre-select a specific angle. Similar to the combs without any level whatsoever, the bubble level comb requires a stylist to make a judgment call based on his or her vantage point. This strategy may prove to be difficult when the stylist is attempting to read the bubble level using a client's hair as the backdrop.

To this end, a need exists for a hair styling device that removes human error and allows stylists to pre-select specific angles. It is to such a hair styling device that the inventive concepts disclosed herein are directed.

BRIEF DESCRIPTION OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale or in schematic in the interest of clarity and conciseness. Not every component may be labeled in every drawing. Like reference numerals in the figures may represent and refer to the same or similar element or function. In the drawings.

DETAILED DESCRIPTION OF EXEMPLARY EMBODIMENTS

Figure 1:
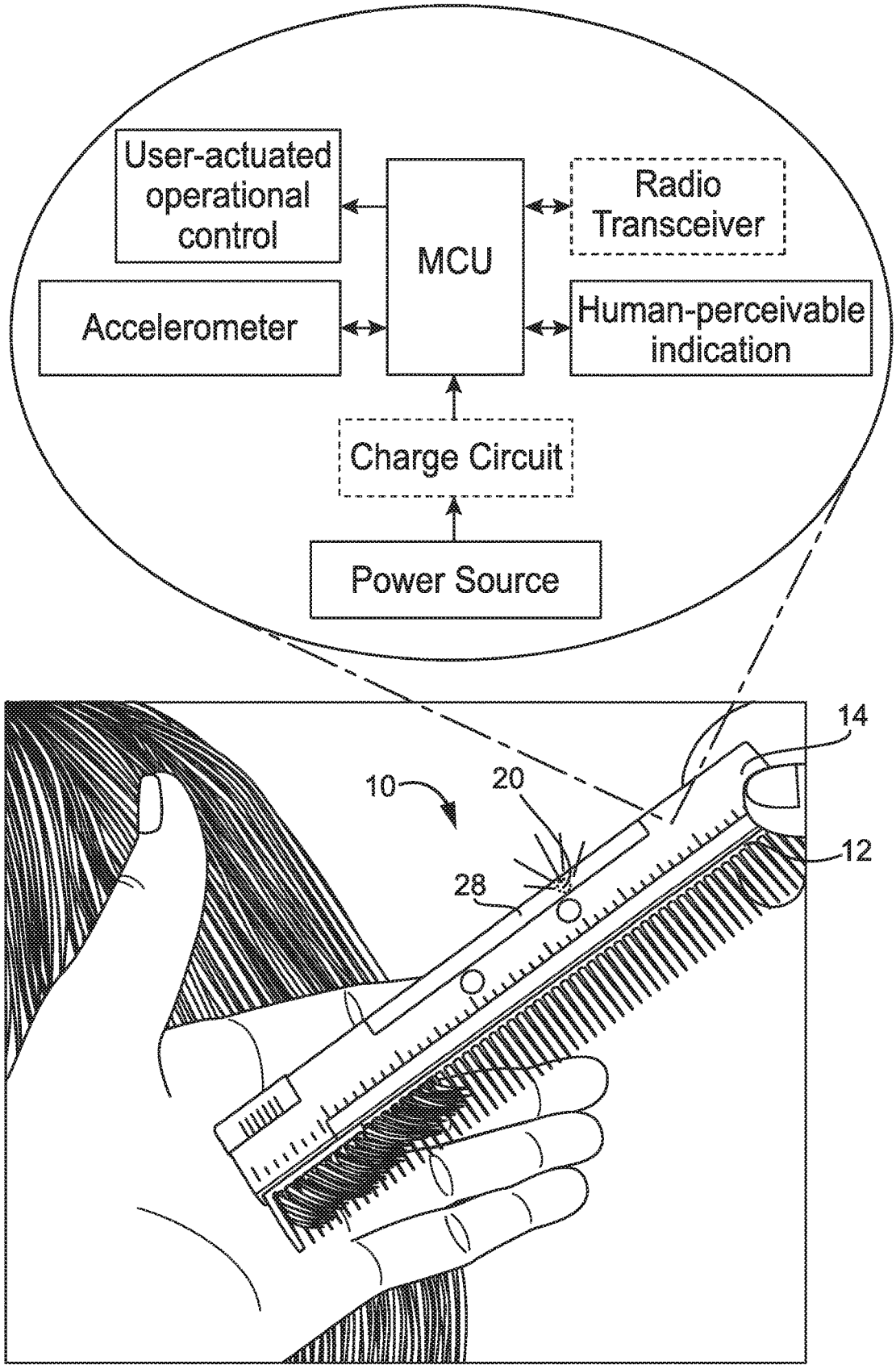
FIG. 1 is a perspective view of a hair styling device constructed in accordance with the inventive concepts disclosed herein shown in association with a hair comb and in use by a hair stylist.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. The inventive concepts disclosed herein are capable of other embodiments, or of being practiced or carried out in various ways. Also, it is to be understood that the phraseology and terminology employed herein is for the purpose of description and should not be regarded as limiting the inventive concepts disclosed and claimed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising," "includes," "including," "has," "having," and any variations thereof, are intended to cover a non-exclusive inclusion. For example, a process, method, article, or apparatus that comprises a list of elements is not necessarily limited to only those elements, and may include other elements not expressly listed or inherently present therein.

Unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B is true (or present).

In addition, use of the "a" or "an" are employed to describe elements and components of the embodiments disclosed herein. This is done merely for convenience and to give a general sense of the inventive concepts. This description should be read to include one or at least one and the singular also includes the plural unless it is obvious that it is meant otherwise.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Referring now to the drawings, and in particular to FIG. 1, a stylist using a hair styling device 10 constructed in accordance with the inventive concepts disclosed herein is shown as being attached to a comb 12. Broadly, the hair styling device 10 includes a housing 14 configured to fit comfortably in a user's hand, an electronic-based alignment means 16 for determining the angle of orientation of the housing 14 (FIGS. 1-5), and a user-actuated operational control 18 such that the housing's 14 desired angle can be user-selected and stored in the electronic memory to facilitate the stylist's positioning of the associated comb 12 at a consistent user-selected angle.

FIG. 1 also schematically illustrates components that may be associated with the electronic-based alignment means 16 such that the electronic-based alignment means 16 provides a human-perceivable indication 20 of the angle of orientation of the housing 14. The electronic-based alignment means 16 may provide, for instance, a distinct human-perceivable indication 20 at 0°, 45°, 90°, and 180°. The electronic-based alignment means 16 can be selectively locked by a user to provide a human-perceivable indication 20 at a desired angle (that may be user-selected) using the user-actuated operational control 18 such that the electronic-based alignment means 16 provides a human-perceivable indication 20 when the housing 14 is approaching and has arrived at the precise desired angle.

By way of example (and not limitation), the user-actuated operational control 18 may be a switch, button, or combinations thereof. By way of example (and not limitation), the human-perceivable indication 20 may be visual, audible, tactile, or combinations thereof. For example, the human-perceivable indication 20 may be a light, an audible speaker with or without Bluetooth capabilities, a vibration motor, or combinations thereof.

The housing 14 is shown in the illustrative embodiment to be generally rectangular in shape, but the housing 14 may be configured in a variety of shapes. The housing 14 includes a front face 22 and a back face 24. The housing 14 has a size such that the housing 14 may be removably positioned on (or even attached to) a variety of hair styling tools such as, for example, the comb 12 as in FIGS. 1, 2, and 4, any other type of hair comb, hair brush, or hair clippers (as illustrated in association with FIG. 5).

The comb 12 in FIG. 1 is illustrated as being a conventional hair comb having a plurality of hair comb teeth 26. The comb 12 attaches or fits into a grooved mounting assembly 27 in the housing 14 such as to be slidably removable for easy interchangeability with other hair styling tools. By way of example, another hair styling tool may be hair clippers (FIG. 5), brushes, or trimmers.

Figure 5:
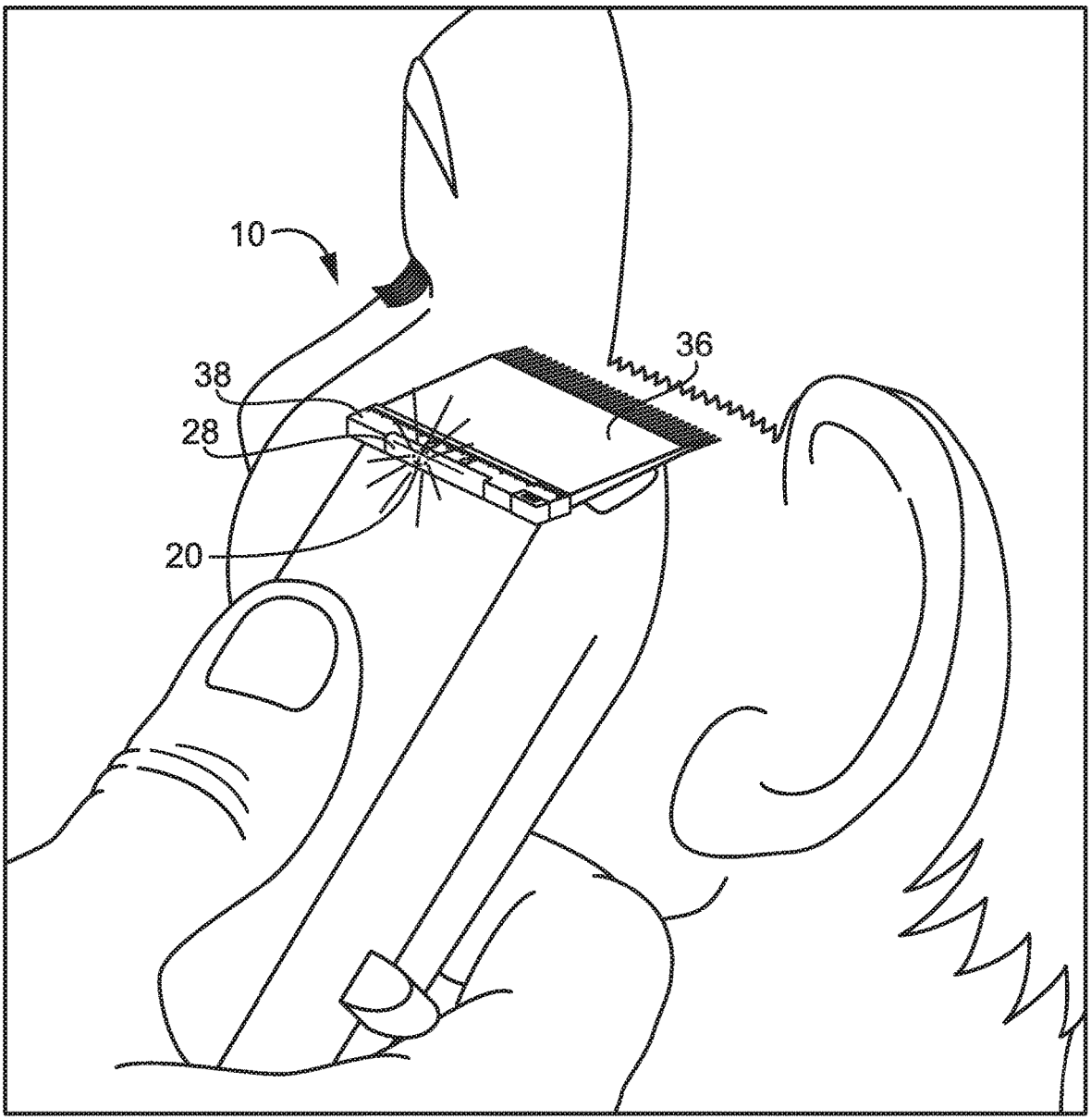
FIG. 5 is a perspective view of the housing of a hair styling device shown attached to hair clippers.

Referring now to FIGS. 1 and 5, in one embodiment, the housing 14 has one multi-color LED light 28 positioned such that the multi-color LED light 28 is visible from both the front face 22 and the back face 24 of the housing 14. The one multi-color LED light 28 provides a human-perceivable indication 20 of the angle of orientation of the attached hair comb 12 as measured by the electronic-based alignment means 16. In this approach, one of the plurality of colors produced by the multi-color LED light 28 would be respectively assigned to one of the measurements provided by the electronic-based alignment means 16 (e.g., 0°, 45°, 90°, and 180°). The one multi-color LED light 28 may also provide a respective human-perceivable indication 20 when the housing 14 is approaching and has arrived at the precise-desired angle that was stored by the electronic-based alignment means 16.

In one embodiment, the one multi-color LED light 28 is positioned on an edge 30 of the housing 14, but the multi-color LED light 28 may be configured in a variety of shapes and placements. For example, the multi-color LED light 28 may be spaced farther inwardly relative to the edge 30 of the housing 14. It will also be appreciated by those of ordinary skill in the art that the size of the multi-color LED light may be varied. For example, the multi-color LED light 28 may run less than the entire length of the housing 14 or may run the entire length of the housing 14.

Figure 4:
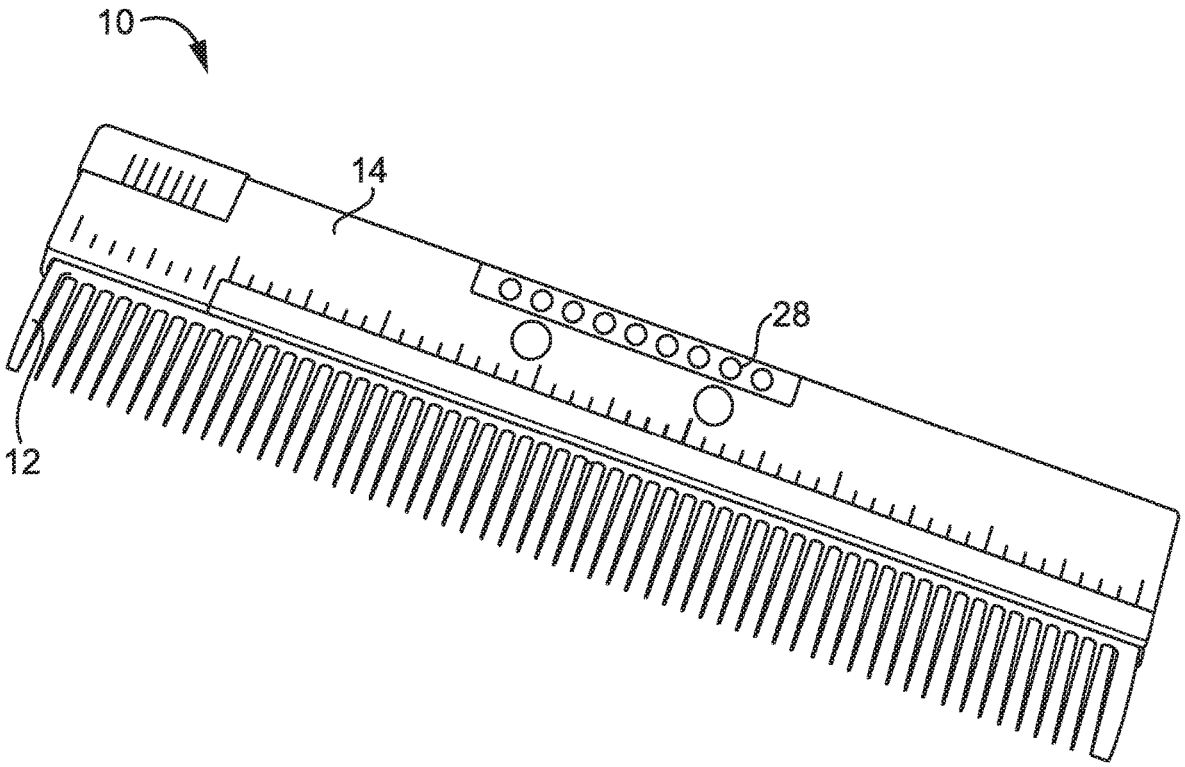
FIG. 4 is a perspective view of another means of providing a human-perceivable indication of the orientation of a hair styling device.

Referring now to FIG. 4, another embodiment of an LED light is illustrated. The LED light is similar to the one LED light 28 described above except the embodiment in FIG. 4 utilizes a plurality of multi-color LED lights 32 working together to provide a human-perceivable indication 20 of the angle of orientation of the attached hair comb 12 as measured by the electronic-based alignment means 16. In the embodiment specifically illustrated by FIG. 4, nine individual LED lights are provided. These lights may be programmed to light individually or collectively in one or more colors based on the angle measured by electronic-based alignment means 16. The plurality of multi-color LED lights 32 may also provide a human-perceivable indication 20 when the housing 14 is approaching and has arrived at the precisely desired angle that was stored by the electronic-based alignment means 16. The plurality of multi-colored LED lights 32 is preferably visible from both the front face 22 and the back face 24 of the housing 14.

In one embodiment, the plurality of multi-colored LED lights 32 is positioned on an edge 30 of the housing 14, but the plurality of multi-color LED lights 32 may be configured in a variety of shapes and placements. For example, the plurality of multi-color LED lights 32 may be spaced farther inwardly relative to the edge 30 of the housing 14. It will also be appreciated by those of ordinary skill in the art that the number of multi-color LED lights may be varied. For example, the plurality of multi-color LED lights 32 may run less than the entire length of the housing 14 or may run the entire length of the housing 14.

Figure 2:
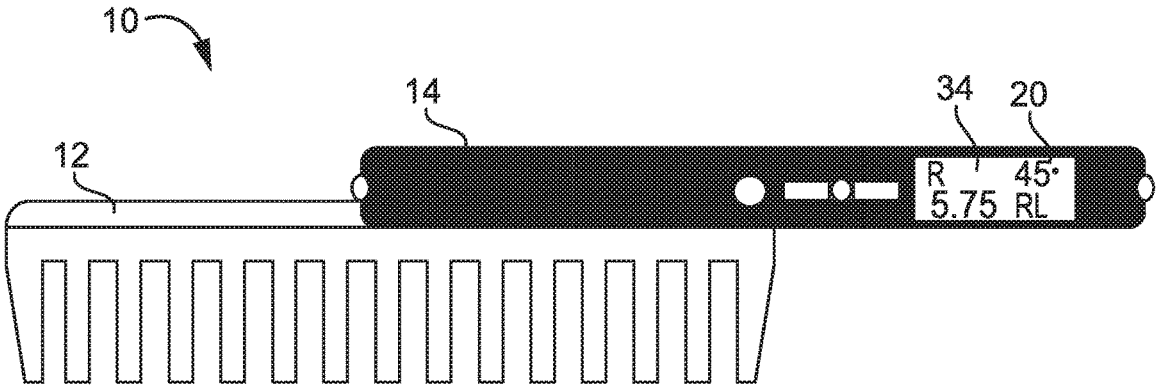
FIG. 2 is an elevation view of a different embodiment of a housing for the hair styling device shown being attached to a hair comb.
Figure 3:
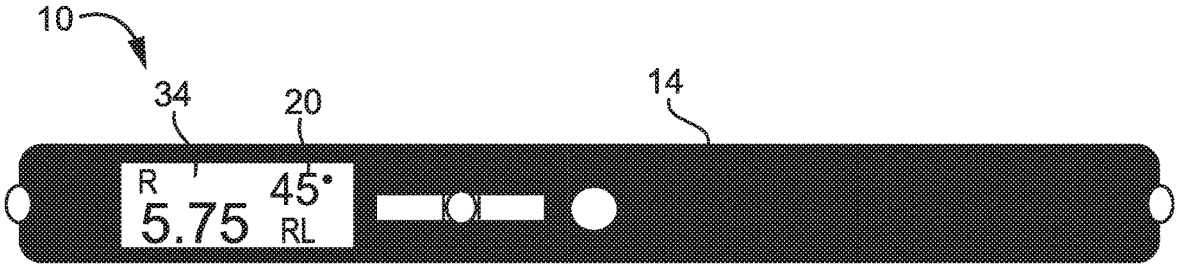
FIG. 3 is a plan view of a different embodiment of a housing for the hair styling device.

Referring now to FIGS. 2 and 3, another embodiment of a housing 14 is illustrated, wherein the housing 14 has an electronic screen 34 in communication with the electronic-based alignment means 16 for displaying data.

The hair styling device 10 may include a means (not shown) for measuring a length of hair passing through the attached hair comb. As shown in FIGS. 2 and 3, the electronic screen 34 may display data such as the length of the hair passing through the attached hair comb 12 and the angle of orientation of the attached hair comb 12. The electronic screen 34 may also display the human-perceivable indication 20 of the angle of orientation of the attached hair comb 12.

Referring now to FIG. 5, another embodiment of a hair styling device 10 is shown having a smaller housing 38 sized and shaped to facilitate use with and attachment to hair clippers 36. The smaller housing 38 may be configured in a variety of sizes and shapes.

The components of the housing 14 may be formed of any suitable polymeric material or any other suitable waterproof or water-resistant material.

As indicated above, the housing 14 may be secured to the comb 12 or clippers 36 by sliding the comb 12 or clippers 36 into the grooved mounting assembly 27 in the housing 14. The use of the grooved mounting assembly 27 permits the housing 14 to be quickly and easily mounted to the comb 12 or clippers 36 and removed therefrom without requiring the comb 12 or clippers 36 to be structurally altered. With the housing 14 secured to the comb 12 or clippers 36, a stylist may be able to more easily utilize the hair styling device 10.

In one embodiment, the hair styling device 10 includes a direction-indicating element 40 visible from at least one of the front face 22 and the back face 24 of the housing 14. The direction-indicating element 40 provides a human-perceivable indication 20 of the angle of orientation of the attached hair comb 12 as measured by the electronic-based alignment means 16. The direction-indicating element 40 also provides a human-perceivable indication 20 when the housing 14 is approaching and has arrived at the precise desired angle that was stored by the electronic-based alignment means 16. By way of example, the direction-indicating element 40 may be an arrow.

Figure 6:
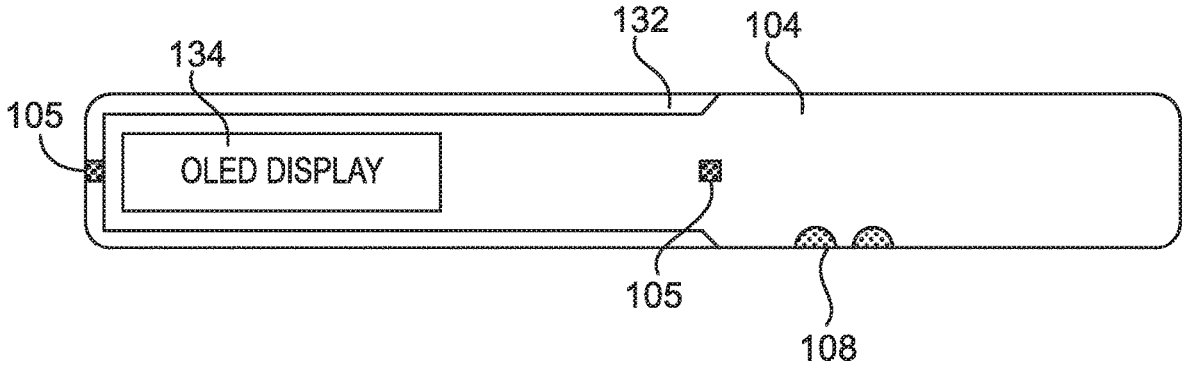
FIG. 6 is a perspective view of a different embodiment of a housing for a hair styling device.
Figure 7:
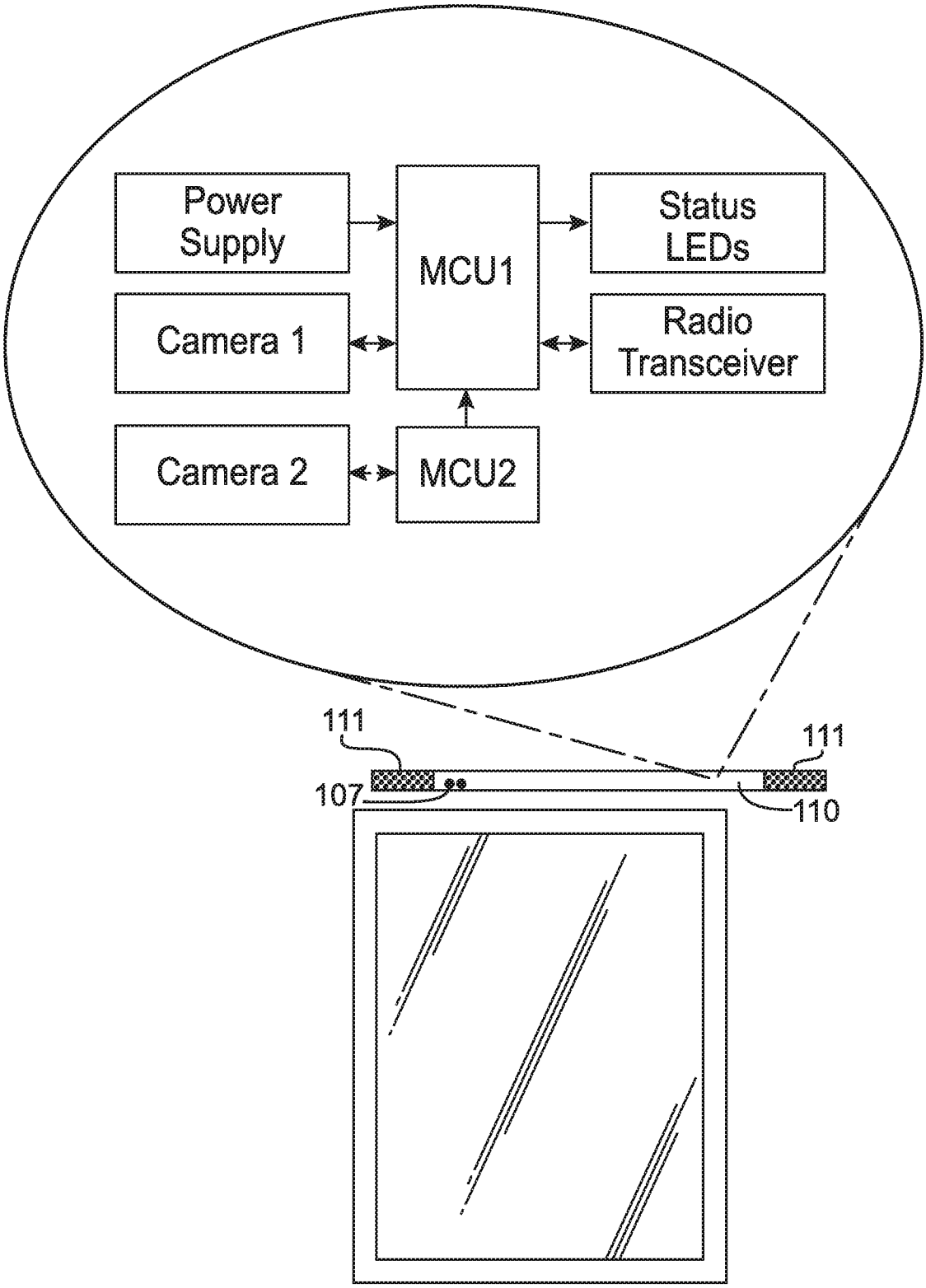
FIG. 7 is a perspective view of a base station for a housing for a hair styling device.
Figure 8:
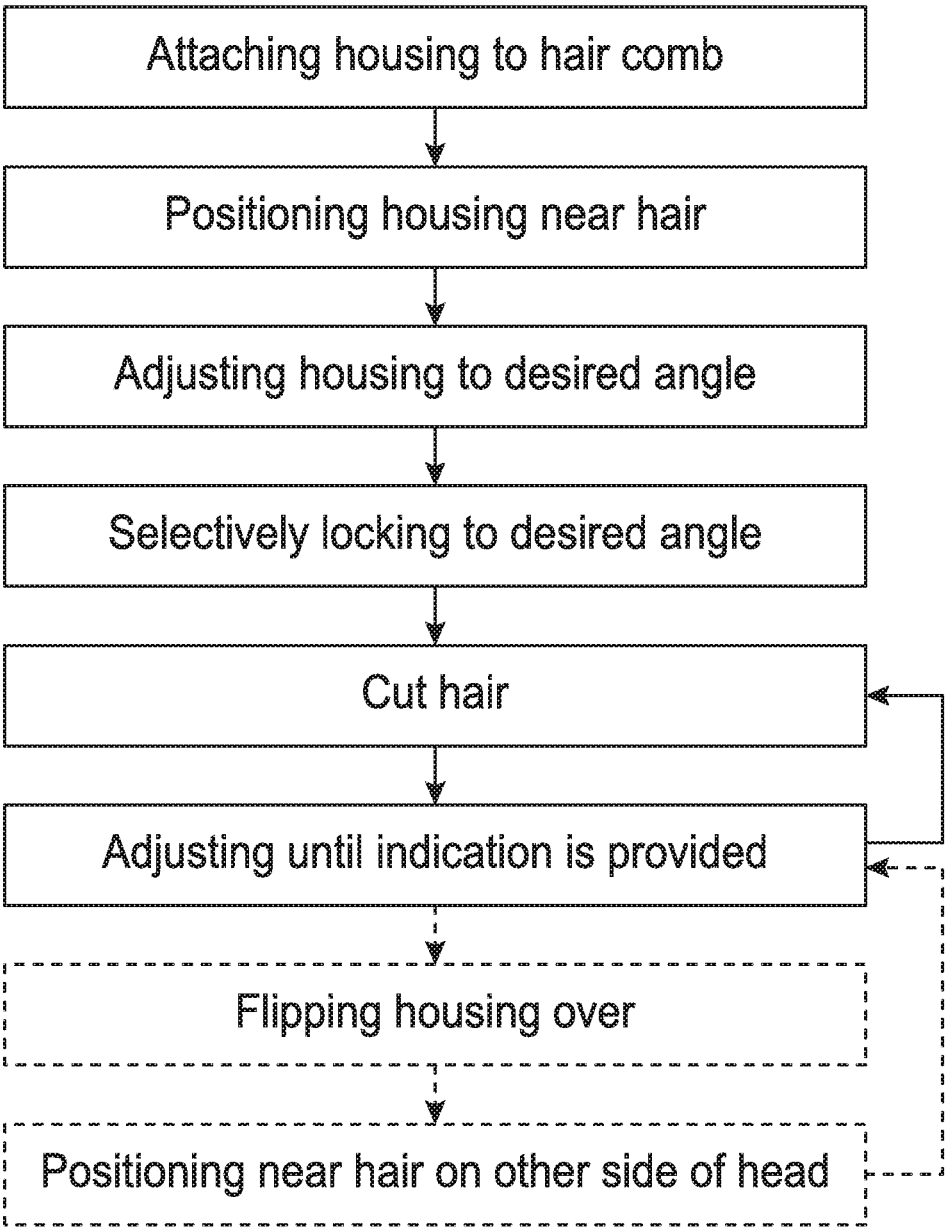
FIG. 8 illustrates a method for cutting hair using the hair styling device in accordance with the inventive concepts disclosed herein.

Referring now to FIGS. 6 and 7, another embodiment of a hair styling device 100 is shown as being attached to a comb 102. Broadly the hair styling device 100 includes a housing 104 configured to fit comfortably in a user's hand, interact with a base station 110, and operably fit with a charging cradle 112. The comb 102 can be detached and disinfected using antiseptic procedures (commonly known).

In one embodiment, the housing 104 has two IR emitters 105, an electronic screen 134 in communication with the electronic-based alignment means 106 for displaying data, one or more user-actuated operational controls 108, and a plurality of multi-color LED lights 132 working together to provide a human-perceivable indication 120 of the angle of orientation of the attached hair comb 102 as measured by the electronic-based alignment means 106.

The base station 110 includes an electronic-based alignment means 106 for determining the angle of orientation of the housing 104. The housing 104 includes a user-actuated operational control 108 such that the housing's 104 desired angle can be user-selected and stored in the electronic memory to facilitate the stylist's positioning of the associated comb 102 at a consistent user-selected angle. The housing 104 and base station 110 work in concert to measure cut length and the angle of orientation of the housing 104, with the base station 110 measuring the angle and then wireless providing the resulting data to the housing 104 of hair styling device 100. The base station 110 communicates with the housing 104 through, by way of example and not by limitation, a wireless link. The base station 110 may include an electronic screen 134 in communication with the electronic-based alignment means 106 for displaying alignment (and potentially even hair length) data.

FIG. 7 also schematically illustrates components that may be associated with the electronic-based alignment means 106 such that the electronic-based alignment means 106 provides a human-perceivable indication 120 of the angle of orientation of the housing 104. The electronic-based alignment means 106 may provide, for instance, a distinct human-perceivable indication 120 at 0°, 45°, 90°, and 180°. The electronic-based alignment means 106 can be selectively locked by a user to provide a human-perceivable indication 120 at a desired angle (that may be user-selected) using the user-actuated operational control 108 such that the electronic-based alignment means 106 provides a human-perceivable indication 120 when the housing 104 is approaching and has arrived at the precise desired angle.

By way of example (and not limitation), the user-actuated operational control 108 may be a switch, button, or combinations thereof. By way of example (and not limitation), the human-perceivable indication 120 may be visual, audible, tactile, or combinations thereof. For example, the human-perceivable indication 120 may be a light, an audible speaker with or without Bluetooth capabilities, a vibration motor, or combinations thereof.

The base station 110 performs all distance measurements for the hair styling device 100 and may be located, for example and not by way of limitation, above the stylist's work area, such as above the mirror of the stylist's station. The base station 110 is shown in the illustrative embodiment to be generally rectangular in shape with infrared cameras 111 at each end, but the base station 110 may be configured in a variety of shapes. The cameras 111 compute the distance of the housing 104 from the base station 110, and by tracking this distance over time can measure length of cut. There may also be an LED and/or a plurality of LEDs on the base station 110 to indicate whether or not the housing 104 is linked with the base station 110 and to show that the base station 110 is powered on.

The electronic-based alignment means 106 in the base station 110 includes a power supply, one or more microcontrollers (MCUs) for capturing and processing data from each camera 111, a transceiver to communicate with the housing 104, and one or more multi-color LED lights 107 to indicate the linking status—i.e., whether or not the housing 104 is linked with the base station 110. By way of example (and not limitation), the transceiver communication mechanism may be a 802.15.4 ZigBee low-power radio. The communication link communicates with the housing 104, and may identify and pair with the housing 104, acquire start and stop points for distance measurement, and to transmit distance information and status messages to the housing 104 for display to the stylist.

The base station 110 may also include firmware such as camera image capture and recognition, measurement of distance of housing 104 from the camera data, and communication with the housing 104. Image capture will process the incoming image data to identify and track the housing 104, which may have LED lights that blink at different rates for easy identification. In one embodiment, MCU2 computes coordinates from the image data then passes the coordinates to MCU1. MCU1 does its own image capture and feeds that data into the final measurement engine, which takes the coordinates from both MCU1 and MCU2 to compute the final distance from the housing 104. These coordinates are then combined with information acquired from the housing 104, and compared against the distance stored from when the housing 104 set the stroke length using its interface.

By way of example (and not limitation), the housing of the base station 110 may be formed of any suitable polymeric material. Preferably, the base station 110 may be injection molded and comprise a base shell and two transparent apertures that filter light outside of the infra-red spectrum to ease the processing of image data.

In accordance with another embodiment of the present disclosure, a method of providing the housing necessary to cut hair is provided using the following steps:

(i) positioning a housing attached to a hair comb near the hair, the housing comprising an electronic-based alignment means that determines the angle of orientation of the attached hair comb, such that the electronic-based alignment means provides a human-perceivable indication of the angle of orientation and wherein the electronic-based alignment means can be selectively locked to a desired angle, such that the electronic-based alignment means selectively provides a human-perceivable indication when the attached hair comb is oriented at the desired angle;

(ii) adjusting the housing to the desired angle;

(iii) locking the electronic-based alignment means at the desired angle; and (iv) adjusting the housing relative to the hair until the electronic-based alignment means provides the human-perceivable indication.

In one embodiment, the method further comprises providing the housing necessary to cut hair on the other side of the head by flipping the housing over and repeating steps (i)-(iv).

In one embodiment, the method further comprises an electronic-based uploading means for storing specific information about the haircut.

From the above description, it is clear that the inventive concepts disclosed herein are well adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the scope of the inventive concepts disclosed and as defined in the appended claims.

The invention claimed is:

1. A hair styling device comprising:

a housing, configured to fit comfortably in a user's hand and to be removably attached to a comb, wherein the comb has a plurality of hair comb teeth, the housing having a front face and a back face and an electronic display configured to display a current angle of orientation;

an electronic-based alignment system that determines the current angle of orientation of the housing;

a user-actuated operational control, configured to select a selected angle; the selected angle being the current angle of orientation determined by the electronic-based alignment system while the operational control is actuated;

a direction-indicating element configured to provide the user with feedback to guide in positioning the housing back to the selected angle;

a measurement tool for measuring a length of hair passing through the hair comb teeth; and an electronic screen for displaying the length of hair.

2. The housing of claim 1 further comprising a plurality of lights visible from at least one of the front face and the back face of the housing, wherein the plurality of lights together provide an indication of the current angle of orientation of the housing as measured by the electronic-based alignment system.

3. The housing of claim 1 further comprising at least one multi-color LED light visible from at least one of the front face and the back face of the housing, wherein the at least one multi-color LED light provides an indication of the current angle of orientation of the housing as measured by the electronic-based alignment system.

4. The housing of claim 1, wherein the housing can be configured to accommodate any type of hair comb.

5. The electronic-based alignment system of claim 1, wherein the human-perceivable indication is audible, the electronic-based alignment means further comprising an audio driver.

6. The electronic-based alignment system of claim 5, the audio driver comprising a Bluetooth transceiver.

7. The hair styling device of claim 1 further comprising an electronic screen in communication with the electronic-based alignment system such that the electronic screen displays the human-perceivable indication of the current angle of orientation.

8. The hair styling device of claim 1, wherein the electronic-based alignment system provides a distinct human-perceivable indication when the current angle of orientation equals 0°.

9. The hair styling device of claim 1, wherein the electronic-based alignment system provides a distinct human-perceivable indication when the current angle of orientation equals 45°.

10. The hair styling device of claim 1, wherein the electronic-based alignment system provides a distinct human-perceivable indication when the current angle of orientation equals 90°.

11. The hair styling device of claim 1, wherein the electronic-based alignment system provides a distinct human-perceivable indication when the current angle of orientation equals 180°.

* * * * *